US011559136B1

(12) United States Patent
Lin

(10) Patent No.: US 11,559,136 B1
(45) Date of Patent: Jan. 24, 2023

(54) FOLD-IN-HALF TABLE HAVING PLANAR CROSS BRACE

(71) Applicant: Dongguan Shichang Metals Factory Ltd., DongGuan (CN)

(72) Inventor: Chen-Kang Lin, DongGuan (CN)

(73) Assignee: Dongguan Shichang Metals Factory Ltd., DongGuan (CN)

( * ) Notice: Subject to any disclaimer, the term of this patent is extended or adjusted under 35 U.S.C. 154(b) by 0 days.

(21) Appl. No.: 17/382,719

(22) Filed: Jul. 22, 2021

(51) Int. Cl.
*A47B 3/087* (2006.01)

(52) U.S. Cl.
CPC ..... *A47B 3/087* (2013.01)

(58) Field of Classification Search
CPC ..... A47B 3/087; A47B 3/083
USPC ..... 108/127, 132
See application file for complete search history.

(56) References Cited

U.S. PATENT DOCUMENTS 2,708,145 A * 5/1955 Anderson ..... A47B 3/0918 108/127
2,845,316 A * 7/1958 Bailey ..... A47B 3/08 403/68
5,109,778 A * 5/1992 Berkowitz ..... A47B 3/0911 108/127
5,636,578 A * 6/1997 Rizzi ..... A47B 3/0911 108/132
5,638,761 A * 6/1997 Berkowitz ..... A47B 3/0916 108/132
5,673,633 A * 10/1997 Pfister ..... A47B 3/0815 108/131
5,913,272 A * 6/1999 Gutgsell ..... A47B 3/00 248/439
6,651,568 B1 * 11/2003 Buono ..... A47B 3/0915 108/127
7,278,361 B2 * 10/2007 Zhurong ..... A47B 3/0912 108/169
7,461,601 B2 * 12/2008 Jin ..... A47B 3/087 108/132
7,509,914 B2 * 3/2009 Murphy ..... A47B 3/0911 108/127
7,703,400 B2 * 4/2010 Mockel ..... A47B 7/02 108/115
7,707,948 B2 * 5/2010 Lin ..... A47B 3/08 108/115
7,938,496 B1 * 5/2011 Cattanach ..... A47B 83/045 312/277

(Continued)

*Primary Examiner* — Jose V Chen
(74) *Attorney, Agent, or Firm* — Luedeka Neely Group PC

(57) ABSTRACT

A planar cross brace for stiffening a tabletop of a fold-in-half collapsible table includes an elongate rectangular planar portion having elongate opposing side edges and narrow opposing end edges that are perpendicular to the side edges. A pair of opposing tabs extend from the opposing end edges in a direction perpendicular to the rectangular planar portion. A pair of opposing ribs extend from the opposing side edges in a direction perpendicular to the rectangular planar portion, thereby forming an elongate channel having a U-shaped cross section. The planar cross brace stiffens the inner edge of the tabletop portion to which it is attached, and the stiffening is independent of any connection to the inner edge of the other tabletop portion. This eliminates any need for interlocking features on the inner edges of the tabletop portions, such as those required by prior art tables.

17 Claims, 6 Drawing Sheets

(56) References Cited

U.S. PATENT DOCUMENTS

| | | | | |
|---|---|---|---|---|
| 8,261,676 | B2 * | 9/2012 | VanNimwegen .... | A47B 3/0912<br>108/155 |
| 8,904,943 | B2 * | 12/2014 | Jin ..... | A47B 3/087<br>108/174 |
| 9,913,531 | B1 | 3/2018 | Wang | |
| 2003/0005864 | A1 * | 1/2003 | Wen ..... | A47B 3/0912<br>108/132 |
| 2003/0024445 | A1 * | 2/2003 | Nien ..... | A47B 3/0912<br>108/127 |
| 2004/0221774 | A1 * | 11/2004 | Zheng ..... | A47B 3/0911<br>108/132 |
| 2005/0241551 | A1 * | 11/2005 | Neunzert ..... | F16B 12/24<br>108/132 |
| 2008/0078310 | A1 * | 4/2008 | VanNimwegen .... | A47B 3/0916<br>108/127 |
| 2011/0203493 | A1 * | 8/2011 | Ashby ..... | A47B 3/0818<br>108/115 |
| 2017/0238698 | A1 | 8/2017 | Nye et al. | |

* cited by examiner (Section A-A)

FOLD-IN-HALF TABLE HAVING PLANAR CROSS BRACE

FIELD

This invention relates to the field of furniture. More particularly, this invention relates to a table having a fold-in-half tabletop, collapsible legs, and a planar cross brace for supporting a central region of the tabletop.

BACKGROUND

Banquet and utility tables having collapsible legs and fold-in-half tabletops are well known. Conventionally, fold-in-half tabletops comprise two tabletop halves that are formed of plastic by blow molding or injection molding, or that are formed from honeycomb board, medium-density fiberboard (MDF) or other materials. When the table is unfolded into the use position in which the tabletop halves are aligned, the inner edges of the tabletop halves come together in the center of the tabletop. In some designs, such as described in U.S. Pat. No. 7,096,799 and depicted in FIG. 11, the inner edges of the tabletop halves have interlocking and overlapping features that are integrally formed as parts of the molded tabletop halves. When the tabletop halves are aligned in the use position, the interlocking features 234 and overlapping features 236 of the two halves will be interconnected, thereby forming a more rigid tabletop.

Though a rigid tabletop is desirable, providing integral interlocking and overlapping features in the tabletop halves introduces further complexity and cost to the mold in which the tabletop halves are formed. Further, because these features are located at or near the mold separation line where two mold halves come together, the removal of any plastic burs in the molded parts at the mold separation line is made more difficult. It is easier to remove burs if the mold separation line coincides with a straight edge surface, with no features projecting from the edge surface. Thus, elimination of the interlocking features would make the manufacturing process more efficient.

What is needed, therefore, is a fold-in-half tabletop that is sufficiently rigid and has straight surfaces along the inner edges of the tabletop halves, with no molded interlocking features.

SUMMARY

The above and other needs are met by a collapsible table that has a tabletop, siderails, leg assemblies, hinge assemblies, central support braces, a tubular cross brace, and a planar cross brace. The table includes a first tabletop portion having a top surface, a bottom surface, a first inner edge, and a first outer edge that is parallel to the first inner edge. The table includes a second tabletop portion having a top surface, a bottom surface, a second inner edge, and a second outer edge that is parallel to the second inner edge. The first and second inner edges are adjacent each other when the table is in the use position, and separated from each other when the table is in the storage position.

The side rails include a pair of opposing first side rails attached to the bottom surface of the first tabletop portion between the first inner edge and the first outer edge, and a pair of opposing second side rails attached to the bottom surface of the second tabletop portion between the second inner edge and the second outer edge.

The table includes a first leg assembly that is pivotally connected to the bottom surface of the first tabletop portion between the first side rails, and a second leg assembly that is pivotally connected to the bottom surface of the second tabletop portion between the second side rails. Both leg assemblies extend downward from the respective tabletop portions when the table is in the use position, and are disposed adjacent the respective tabletop portions when the table is in the storage position.

The hinge assemblies comprise a pair of opposing hinge assemblies disposed on a hinge axis that is parallel to the second inner edge of the second tabletop portion. Each hinge assembly connects one of the first side rails to one of the second side rails, so that the first and second tabletop portions are operable to pivot with respect to each other about the hinge axis.

The tubular cross brace is disposed on the hinge axis between the pair of hinge assemblies and is secured to the bottom surface of the second tabletop portion. The planar cross brace is secured to the bottom surface of the first tabletop portion, adjacent and parallel to its first inner edge.

The first central support brace has a first end that is pivotally attached to the first leg assembly and a second end pivotally attached to the tubular cross brace. The second central support brace has a first end pivotally attached to the second leg assembly and a second end pivotally attached to the tubular cross brace.

In some embodiments, the tubular cross brace includes opposing ends that are secured to the opposing hinge assemblies.

In some embodiments, each hinge assembly includes first and second hinge portions that are rotationally attached to each other. The first hinge portion of each hinge assembly is attached to one of the first side rails and the second hinge portion of each hinge assembly is attached to one of the second side rails.

In some embodiments, the planar cross brace includes a pair of opposing tabs disposed at its opposing ends. Each tab extends from the planar cross brace in a direction perpendicular to the bottom surface of the first tabletop portion, wherein each tab is secured to a corresponding one of the first hinge portions. In some embodiments, each tab is welded to the corresponding one of the first hinge portions.

In some embodiments, the planar cross brace includes a pair of opposing ribs disposed along outer edges of a central channel portion of the planar cross brace. The ribs are disposed in parallel to the first inner edge of the first tabletop portion and extend from the planar cross brace in a direction perpendicular to the bottom surface of the first tabletop portion to form a U-shaped cross section within the central channel portion of the planar cross brace.

In some embodiments, the planar cross brace includes multiple apertures disposed within the central channel portion through which fasteners pass to secure the planar cross brace to the bottom surface of the first tabletop portion.

In some embodiments, the tubular cross brace includes multiple apertures through which fasteners pass to secure the tubular cross brace to the bottom surface of the second tabletop portion.

In some embodiments, the planar cross brace includes an elongate rectangular planar portion having elongate opposing side edges and narrow opposing end edges that are perpendicular to the side edges. The planar cross brace includes a pair of opposing tabs extending from each of the opposing end edges in a direction perpendicular to the rectangular planar portion. A pair of opposing ribs are disposed along the opposing side edges in a central region of the rectangular planar portion. The ribs are parallel to the opposing side edges and extend from the rectangular planar portion in a direction perpendicular to the rectangular planar portion, thereby forming a central channel having a U-shaped cross section. The rectangular planar portion includes multiple pairs of opposing arcuate cutouts, each pair disposed adjacent a corresponding one of the tabs at each of the opposing end edges. The cutouts accommodate opposing legs of the first leg assembly, thereby allowing the first leg assembly to lay flat against the bottom surface of the first tabletop portion when the first leg assembly is in the collapsed position.

In some embodiments, the first and second tabletop portions are formed from blow-molded plastic.

In some embodiments, the first and second inner edges of the first and second tabletop portions are linear and parallel to the hinge axis.

In some embodiments, the first leg assembly is pivotally connected to the first side rails and the second leg assembly is pivotally connected to the second side rails.

In some embodiments, the planar cross brace is disposed between the first inner edge and the first outer edge of the first tabletop portion, and the tubular cross brace is disposed between the second inner edge and the second outer edge of the second tabletop portion.

In another aspect, embodiments described herein are directed to a cross brace for stiffening a tabletop of a fold-in-half collapsible table. The cross brace includes an elongate rectangular planar portion having elongate opposing side edges and narrow opposing end edges that are perpendicular to the side edges. A pair of opposing tabs extend from the opposing end edges in a direction perpendicular to the rectangular planar portion. A pair of opposing ribs extend from the opposing side edges in a direction perpendicular to the rectangular planar portion, thereby forming an elongate channel having a U-shaped cross section.

In some embodiments, multiple apertures are disposed in the rectangular planar portion of the cross brace. The apertures are operable to receive fasteners for securing the cross brace to the tabletop.

In some embodiments, the cross brace also includes multiple pairs of opposing arcuate cutouts. Each pair of cutouts are disposed adjacent a corresponding one of the tabs.

BRIEF DESCRIPTION OF THE DRAWINGS

Other embodiments of the invention will become apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
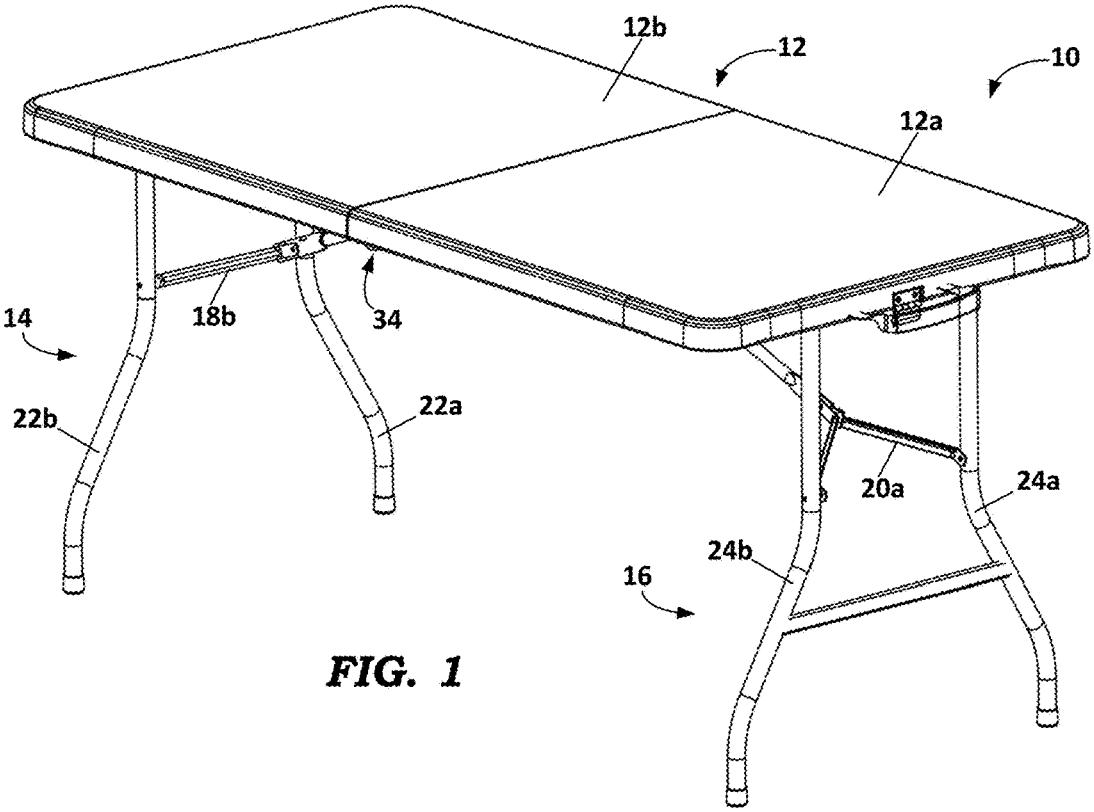
FIG. 1 depicts a top perspective view of a fold-in-half collapsible table in a use position according to a preferred embodiment.
Figure 2:
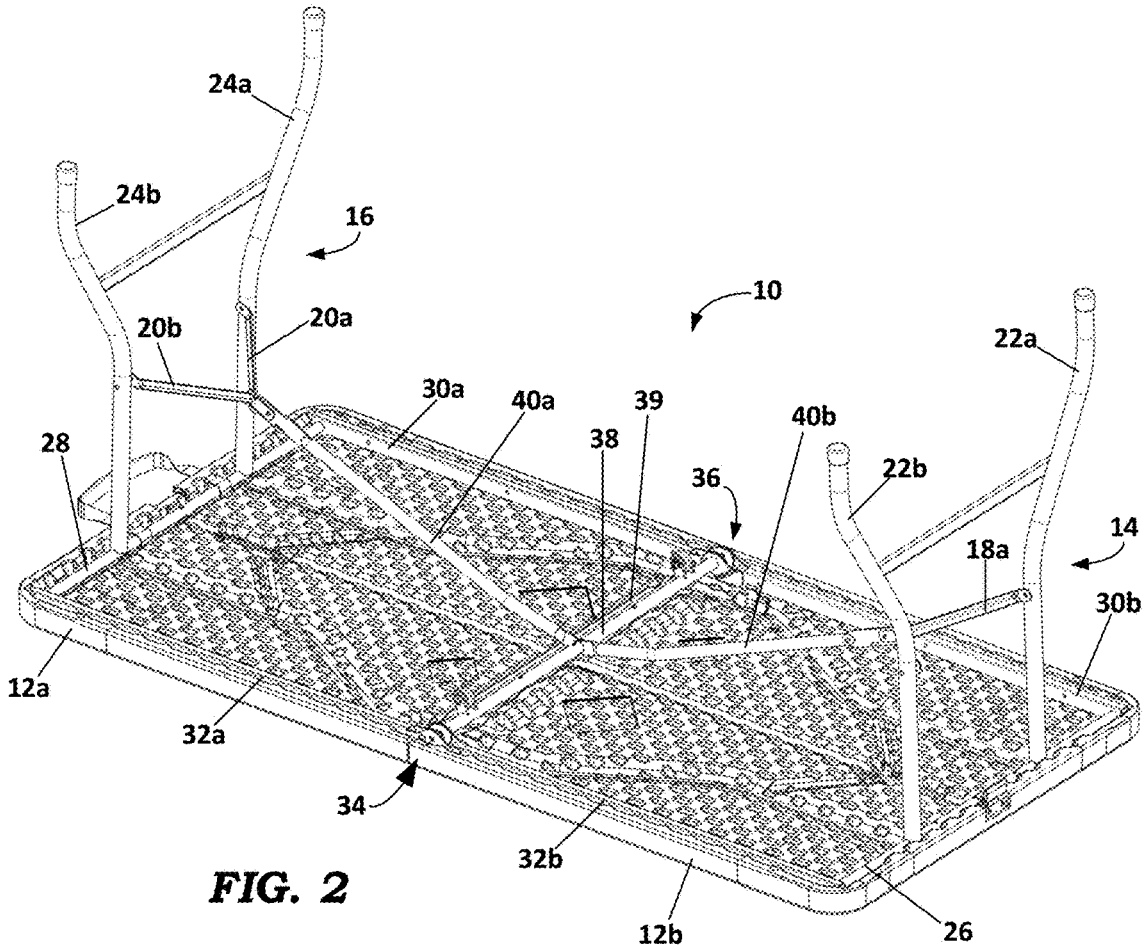
FIG. 2 depicts a bottom perspective view of the fold-in-half collapsible table in the use position according to a preferred embodiment.

As depicted in FIGS. 1-10, a fold-in-half table 10 has a tabletop 12 comprising first and second tabletop portions 12*a* and 12*b*. In the use position depicted in FIGS. 1 and 2, the tabletop 12 is supported by first and second leg assemblies 16 and 14 that extend downward from the tabletop 12. The first leg assembly 16 includes legs 24*a* and 24*b*, and a first cross member 28 to which the upper ends of the legs 24*a*-24*b* are attached. The first cross member 28 is pivotally attached at one end to a first side rail 30*a* and at the other end to an opposing first side rail 32*a*. The second leg assembly 14 includes legs 22*a* and 22*b*, and a second cross member 26 to which the upper ends of the legs 22*a*-22*b* are attached. The second cross member 26 is pivotally attached at one end to a second side rail 30*b* and at the other end to an opposing second side rail 32*b*. The first leg assembly 16 includes articulated braces 20*a* and 20*b* that are pivotally connected to the legs 24*a* and 24*b*, respectively, and to a first end of a central support brace 40*a* to maintain the first leg assembly 16 in the use position. The second leg assembly 14 includes articulated braces 18*a* and 18*b* that are pivotally connected to the legs 22*a* and 22*b*, respectively, and to a first end of a central support brace 40*b* to maintain the second leg assembly 14 in the use position. Second ends of the central support braces 40*a*-40*b* are pivotally connected to a tubular cross brace 38 that spans the width of the second tabletop portion 12*b*.

Figure 3:
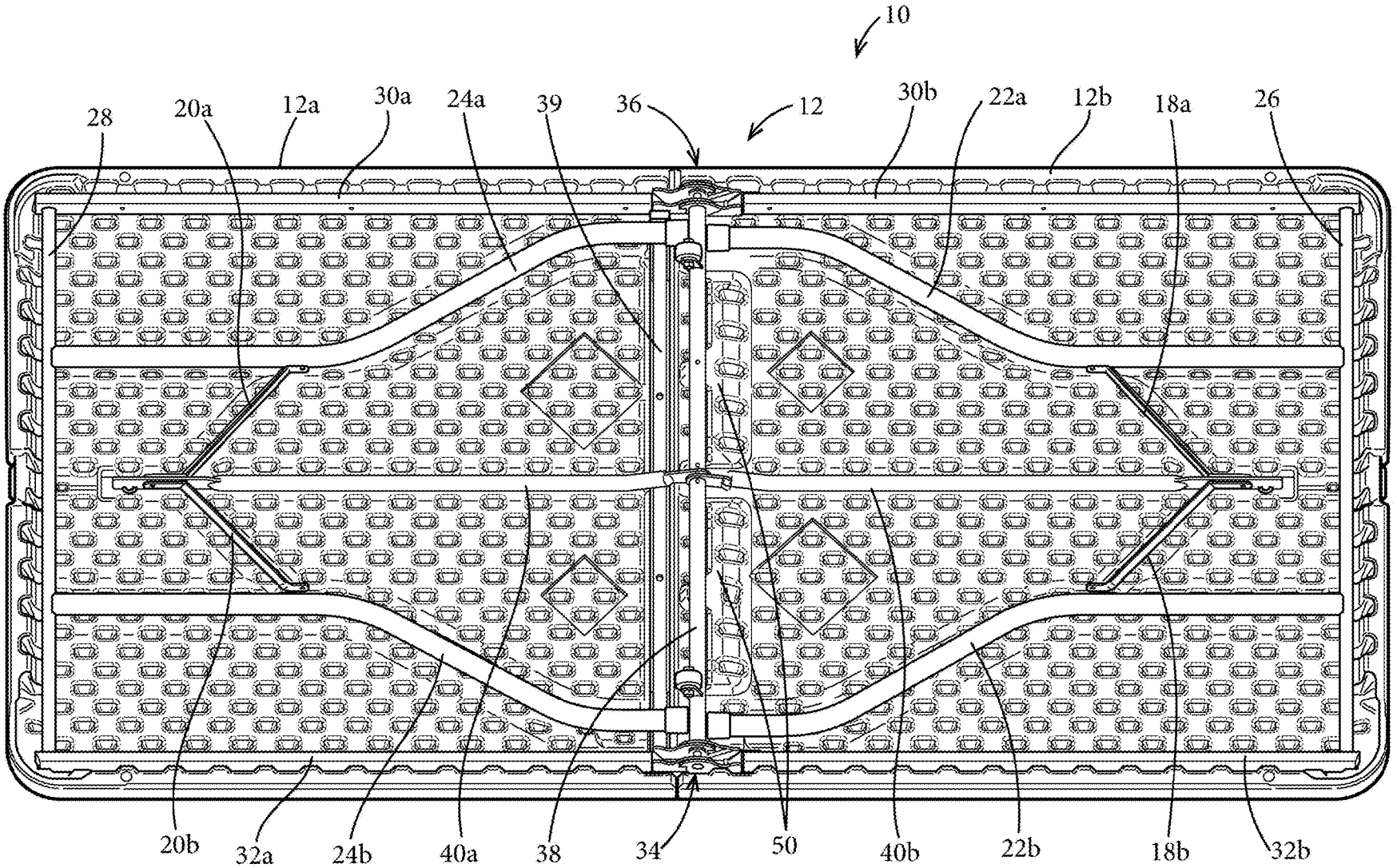
FIG. 3 depicts a bottom plan view of the fold-in-half collapsible table with its legs collapsed according to a preferred embodiment.
Figure 4:
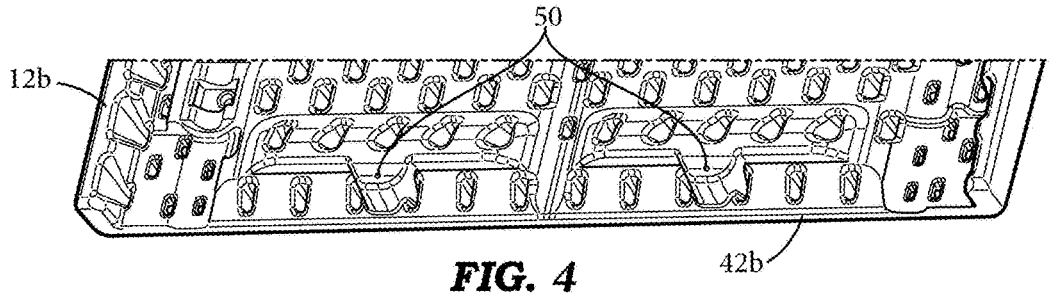
FIG. 4 depicts the inside edge of one half of the tabletop of the fold-in-half collapsible table according to a preferred embodiment.
Figure 5:
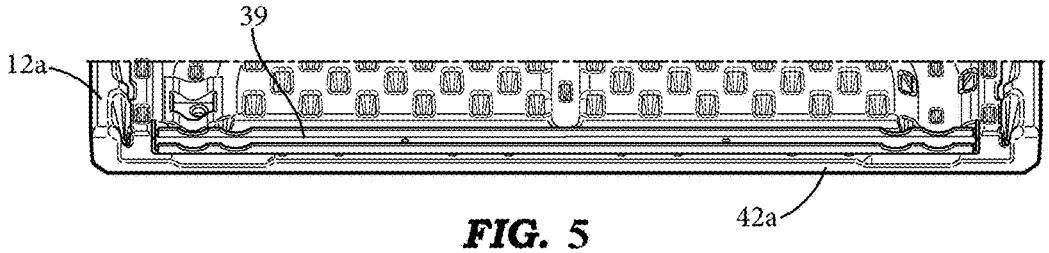
FIG. 5 depicts the inside edge of the other half of the tabletop of the fold-in-half collapsible table according to a preferred embodiment.
Figure 6:
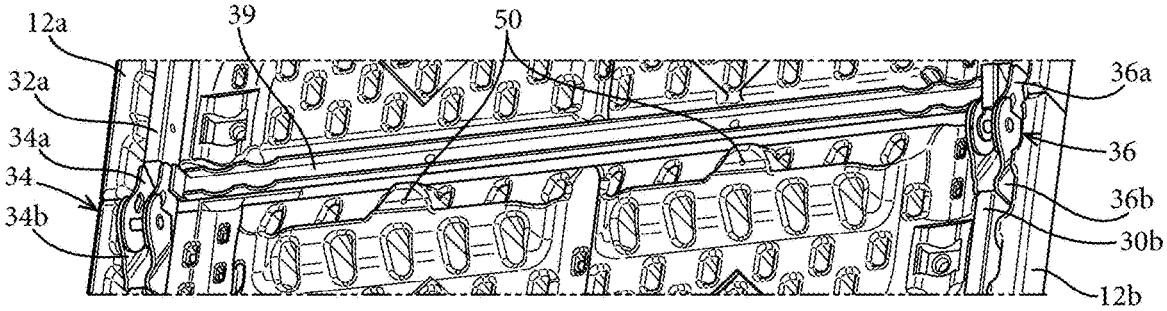
FIG. 6 depicts the junction of the inside edges of the two tabletop halves of the fold-in-half collapsible table in the use position according to a preferred embodiment.
Figure 9:
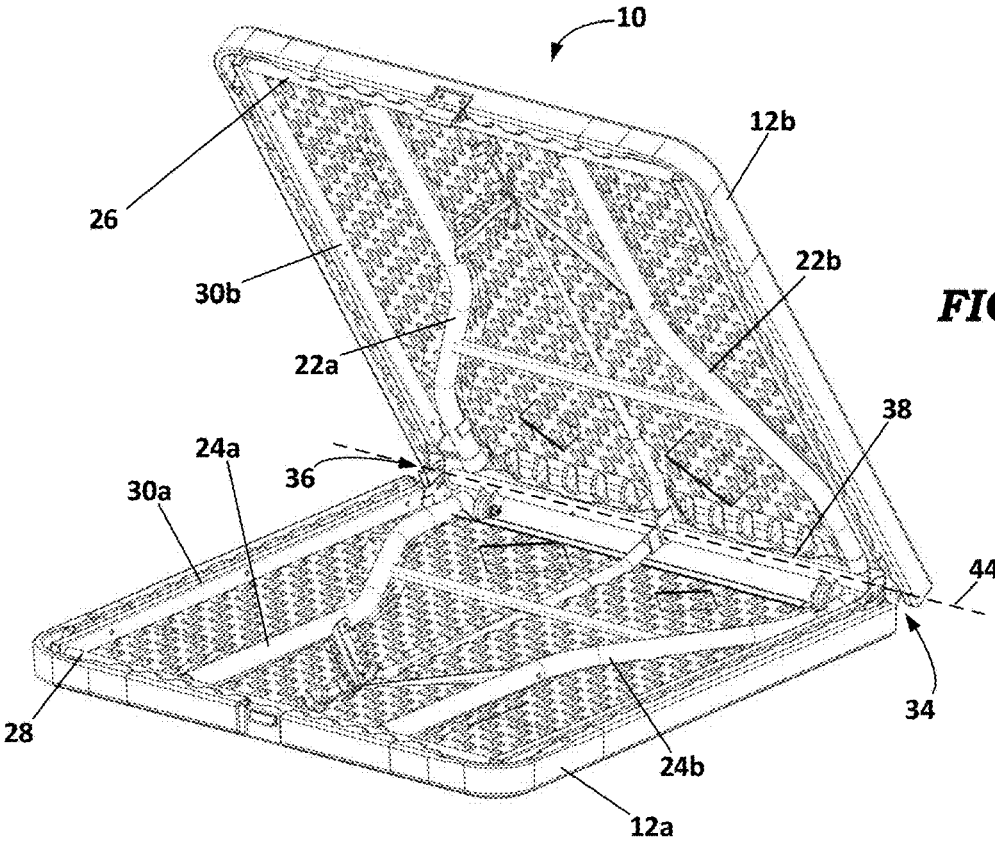
FIGS. 9 and 10 depict the fold-in-half collapsible table in a partially folded position according to a preferred embodiment.
Figure 10:
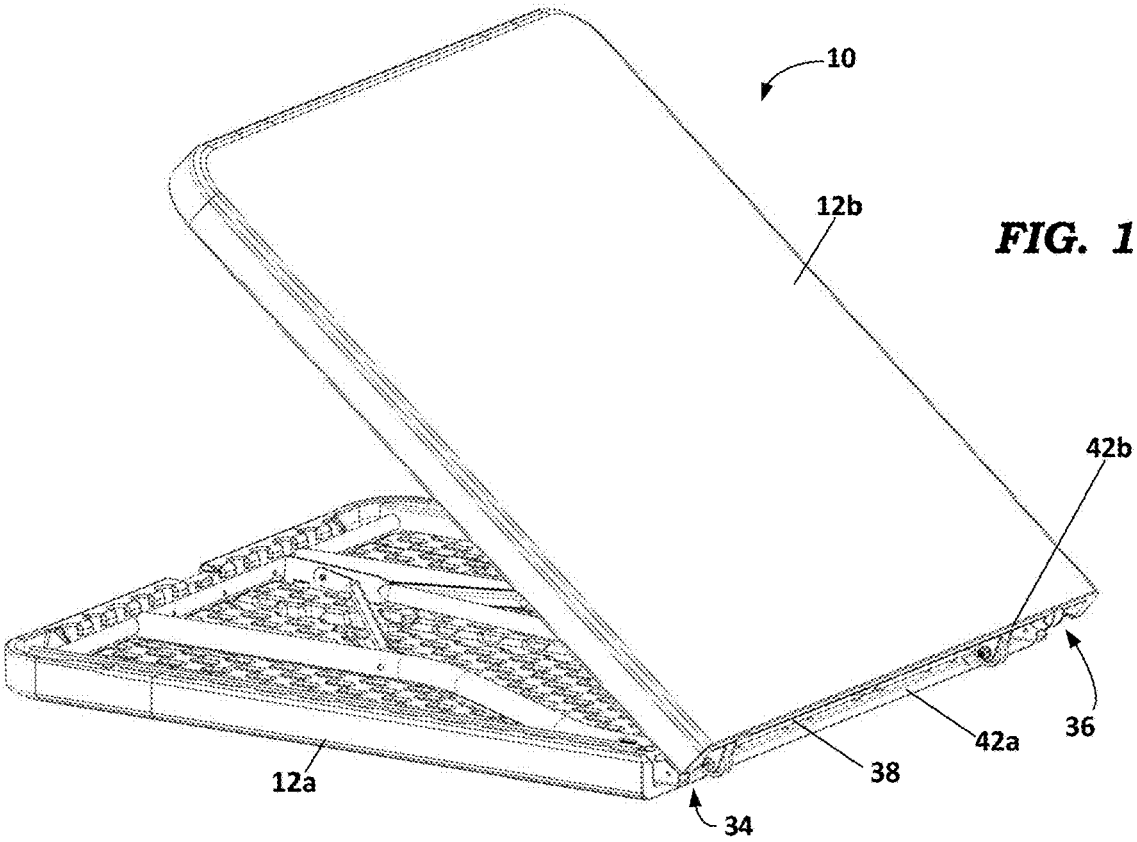

The first side rails 30*a*-32*a* and the second side rails 30*b*-32*b* are preferably attached to the first tabletop portion 12*a* and the second tabletop portion 12*b*, respectively, using screws or other fasteners. The first side rail 30*a* is pivotally connected to the second side rail 30*b* by a hinge assembly 36. As shown in FIG. 6, the hinge assembly 36 includes a first hinge portion 36*a* that is secured to the first side rail 30*a*, and a second hinge portion 36*b* that is secured to the second side rail 30*b*. Similarly, the first side rail 32*a* is pivotally connected to the second side rail 32*b* by a hinge assembly 34. The hinge assembly 34 includes a first hinge portion 34*a* that is secured to the first side rail 32*a*, and a second hinge portion 34*b* that is secured to the second side rail 32*b*. When the leg assemblies 14 and 16 are collapsed into the storage position as shown in FIGS. 3, 9 and 10, the hinge assemblies 34 and 36 allow the tabletop portion 12*a* to pivot relative to the tabletop portion 12*b* along a hinge axis 44.

The tubular cross brace 38 is centered on the hinge axis 44 formed by the hinge assemblies 34-36, with one of its ends attached to the hinge assembly 34 and its other end is attached to the hinge assembly 36. In a preferred embodiment, the cross brace 38 is a cylindrical tube having a circular cross section. In some embodiments, the ends of the tubular cross brace 38 are attached to the hinge assemblies 34 and 36 by weld joints. The tubular cross brace 38 preferably includes apertures through which fasteners pass to attach the tubular cross brace 38 to molded supports 50 extending from the bottom surface of the second tabletop portion 12*b*.

Figure 11:
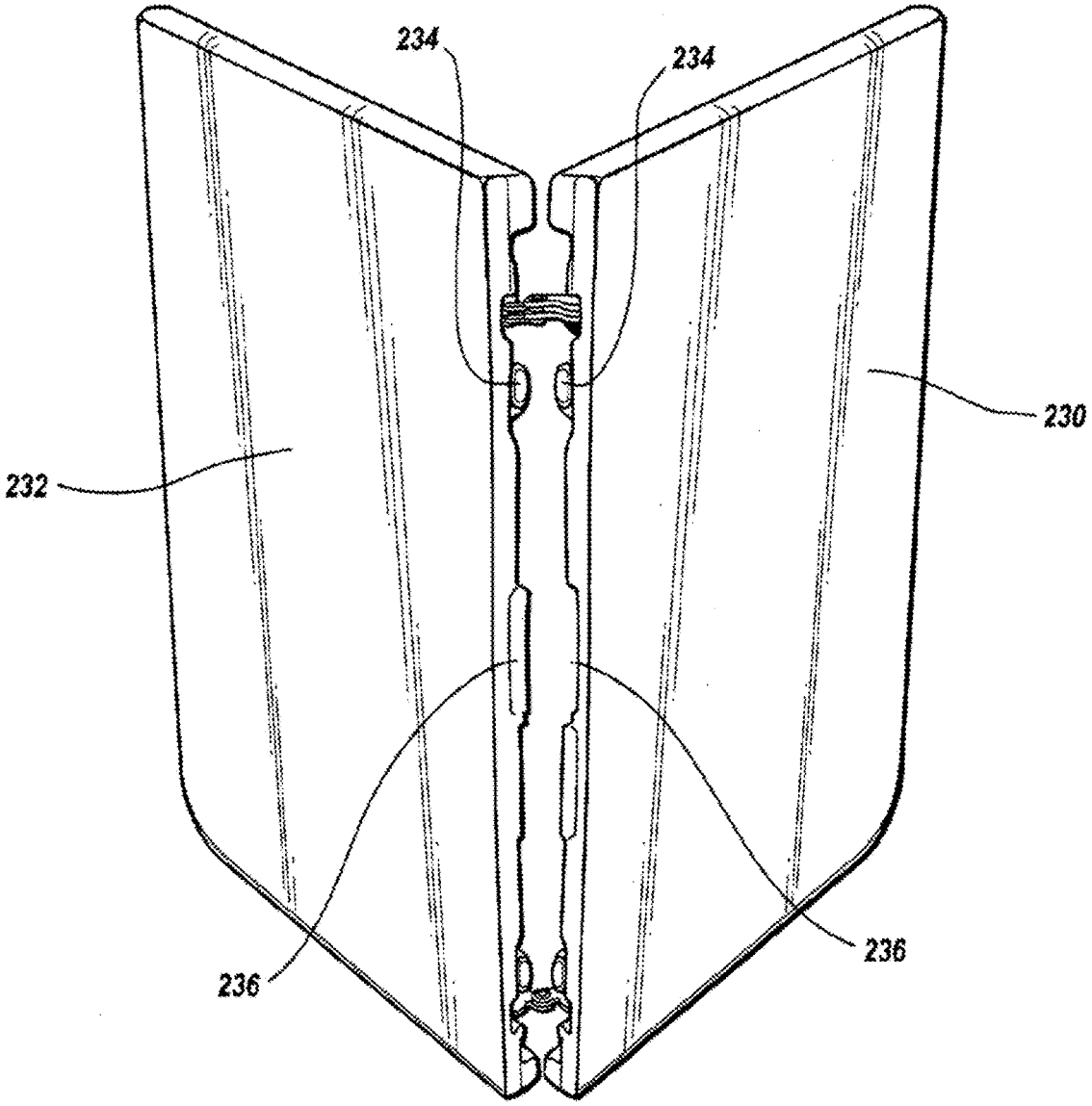
FIG. 11 (Prior Art)
FIG. 11 depicts a prior art fold-in-half table.

As shown in FIGS. 3, 5, 6 and 7, an elongate planar cross brace 39 is attached to the bottom surface of the first tabletop portion 12*a* to provide lateral support. The brace 39 stiffens the inner edge 42*a* of the first tabletop portion 12*a* independently of any connection to the inner edge 42*b* of the second tabletop portion 12*b*. This eliminates any need for interlocking features such as those required by prior art tables (FIG. 11).

Figure 7:
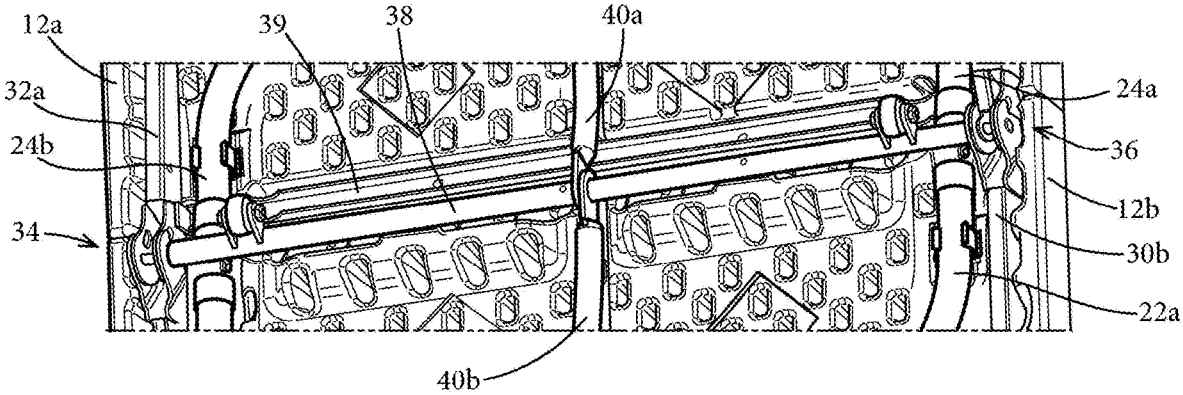
FIG. 7 depicts planar and tubular cross braces at the junction of the two tabletop halves of the fold-in-half collapsible table in the use position according to a preferred embodiment.
Figure 8A:
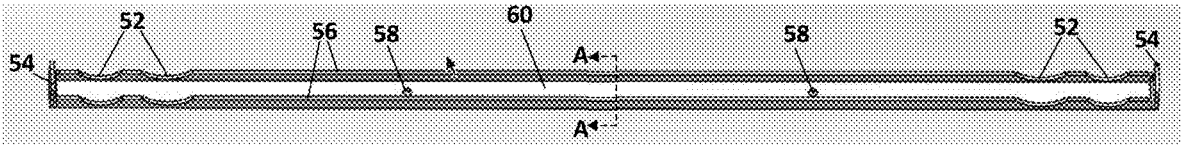
FIGS. 8A-8D depict a planar cross brace of the fold-in-half collapsible table according to a preferred embodiment.
Figure 8B:
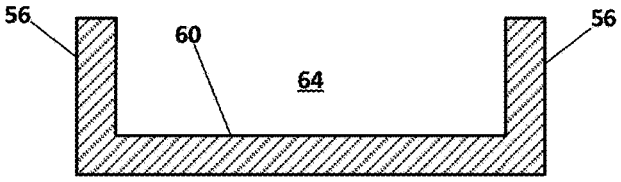

As shown in FIGS. 8A and 8B, a preferred embodiment of the cross brace 39 comprises a rectangular planar portion 60 having tabs 54 at each of its ends that are perpendicular to the planar portion 60. To enhance its rigidity, a central region of the brace 39 includes ribs 56 along its outside edges that are also perpendicular to the rectangular planar portion 60. Pairs of arcuate cutouts 52 are provided in the ribs 56 near the tabs 54 at each end of the cross brace 39. As shown in FIGS. 3 and 7, the cutouts 52 accommodate the lower ends of the legs 24*a*-24*b*, thereby allowing the legs 24*a*-24*b* to lay flat against the bottom surface of the tabletop portion 12*a* when the leg assembly 16 is in the collapsed position.

As shown in FIG. 8B, the ribs 56 and the planar portion 60 form a channel 64 having a U-shaped cross section that provides greater rigidity to the cross brace 39. A pair of apertures 58 are provided through which fasteners may pass to secure the brace 39 to the bottom surface of the first tabletop portion 12*a*. The brace 39 is preferably formed from one piece of steel, with the tabs 54 and ribs 56 integrally formed by bending.

Figure 8C:
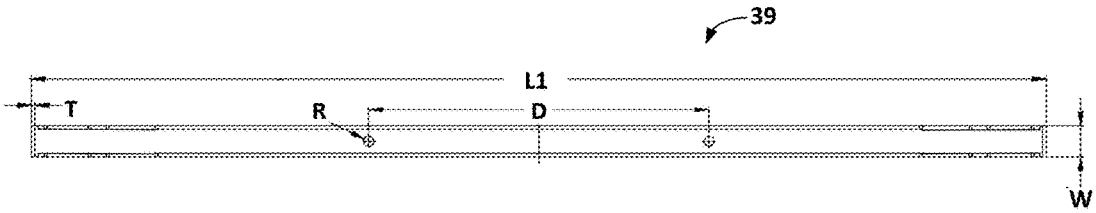
Figure 8D:
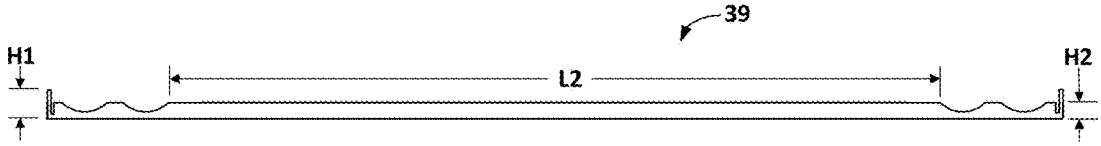

As depicted in FIGS. 8C and 8D, the brace 39 has a width W and a length L1. Its central region has a length L2. The tabs 54 have a height H1 and the ribs have a height H2. All of the components of the brace 39 preferably have the same thickness T. The apertures 58 are spaced apart by a distance D and each has a radius R. In one preferred embodiment, W is 20 mm, L1 is 683.4 mm, L2 is 495 mm, H1 is 18 mm, H2 is 10 mm, D is 220 mm, T is 2.3 mm, and R is 6.5 mm. In another preferred embodiment, W is 20 mm, L1 is 643.5 mm, L2 is 483.5 mm, H1 is 18 mm, H2 is 10 mm, D is 250 mm, T is 2.3 mm, and R is 6.5 mm.

The tab 54 at one end of the brace 39 is secured to the first hinge portion 34*a*, and the tab 54 at the other end of the brace 39 is secured to the first hinge portion 36*a*. In a preferred embodiment, the tabs 54 are attached to the hinge portions 34*a*-36*a* by welding. In alternative embodiments, the attachment is made using fasteners, such as screws or rivets.

In a preferred embodiment, the tabletop portions are formed from blow-molded plastic, and the side rails, leg assemblies, central support braces, tubular cross brace, planar cross brace, and hinge assemblies are formed from steel. In alternative embodiments, the metal components may be formed from other materials, such as aluminum extrusion which may have greater thickness than components formed from steel.

Use of a planar cross brace with a U-shaped channel to stiffen the inner edge of the tabletop portion 12*a* has several advantages over the use of a tubular cross brace, including:

testing has demonstrated that a U-shaped steel channel is stronger than a tubular steel brace;

a U-shaped steel channel costs less than a tubular steel brace;

a U-shaped steel channel weighs less than a tubular steel brace;

because the U-shaped steel channel is stronger than a tubular steel brace, less plastic material is needed in forming the tabletop, which results in lower costs; and attaching a planar brace to the bottom surface of the tabletop is less complicated than attaching a tubular brace.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A fold-in-half collapsible table having a use position and a storage position, the collapsible table comprising:

a tabletop that includes:

a first tabletop portion having a top surface, a bottom surface, a first inner edge, and a first outer edge that is parallel to the first inner edge; and a second tabletop portion having a top surface, a bottom surface, a second inner edge, and a second outer edge that is parallel to the second inner edge wherein the first and second inner edges are adjacent each other when the table is in the use position, and separated from each other when the table is in the storage position;

a pair of opposing first side rails attached to the bottom surface of the first tabletop portion between the first inner edge and the first outer edge;

a pair of opposing second side rails attached to the bottom surface of the second tabletop portion between the second inner edge and the second outer edge;

a first leg assembly pivotally connected to the bottom surface of the first tabletop portion between the first side rails, the first leg assembly extending downward from the first tabletop portion when the table is in the use position, the first leg assembly disposed adjacent the first tabletop portion when the table is in the storage position;

a second leg assembly pivotally connected to the bottom surface of the second tabletop portion between the second side rails, the second leg assembly extending downward from the second tabletop portion when the table is in the use position, the second leg assembly disposed adjacent the second tabletop portion when the table is in the storage position;

a pair of opposing hinge assemblies disposed on a hinge axis that is parallel to the second inner edge of the second tabletop portion, each hinge assembly connecting one of the first side rails to one of the second side rails, whereby the first and second tabletop portions are operable to pivot with respect to each other about the hinge axis;

a tubular cross brace disposed on the hinge axis between the pair of hinge assemblies and secured to the bottom surface of the second tabletop portion;

a first central support brace having a first end pivotally attached to the first leg assembly and a second end pivotally attached to the tubular cross brace;

a second central support brace having a first end pivotally attached to the second leg assembly and a second end pivotally attached to the tubular cross brace; and a planar cross brace secured to the bottom surface of the first tabletop portion and disposed adjacent and parallel to the first inner edge of the first tabletop portion.

2. The fold-in-half collapsible table of claim 1 wherein the tubular cross brace includes opposing ends that are secured to the opposing hinge assemblies.

3. The fold-in-half collapsible table of claim 1 wherein each hinge assembly includes first and second hinge portions that are rotationally attached to each other, wherein the first hinge portion of each hinge assembly is attached to one of the first side rails and the second hinge portion of each hinge assembly is attached to one of the second side rails.

4. The fold-in-half collapsible table of claim 3 wherein the planar cross brace includes a pair of opposing tabs disposed at opposing ends of the planar cross brace, each tab extending from the planar cross brace in a direction perpendicular to the bottom surface of the first tabletop portion, wherein each tab is secured to a corresponding one of the first hinge portions.

5. The fold-in-half collapsible table of claim 4 wherein each tab is welded to the corresponding one of the first hinge portions.

6. The fold-in-half collapsible table of claim 1 wherein the planar cross brace comprises:

an elongate rectangular planar portion having elongate opposing side edges disposed in parallel to the first inner edge of the first tabletop portion; and a pair of opposing ribs, one disposed at each of the opposing side edges and extending from the rectangular planar portion in a direction perpendicular thereto.

7. The fold-in-half collapsible table of claim 6 wherein the planar cross brace includes multiple apertures disposed within the rectangular planar portion through which fasteners pass to secure the planar cross brace to the bottom surface of the first tabletop portion.

8. The fold-in-half collapsible table of claim 1 wherein the tubular cross brace includes multiple apertures through which fasteners pass to secure the tubular cross brace to the bottom surface of the second tabletop portion.

9. The fold-in-half collapsible table of claim 1 wherein the planar cross brace includes:

an elongate rectangular planar portion having elongate opposing side edges and narrow opposing end edges that are perpendicular to the side edges;

a pair of opposing tabs, the pair including a tab extending from each of the opposing end edges in a direction perpendicular to the rectangular planar portion;

a pair of opposing ribs disposed along the opposing side edges in a central region of the rectangular planar portion, wherein the ribs are parallel to the opposing side edges and extend from the rectangular planar portion in a direction perpendicular to the rectangular planar portion, thereby forming a central channel having a U-shaped cross section; and multiple pairs of opposing arcuate cutouts in the opposing ribs, the cutouts disposed adjacent a corresponding one of the tabs at each of the opposing end edges, the cutouts for accommodating opposing legs of the first leg assembly, thereby allowing the first leg assembly to lay flat against the bottom surface of the first tabletop portion when the first leg assembly is in the collapsed position.

10. The fold-in-half collapsible table of claim 1 wherein the first and second tabletop portions are formed from blow-molded plastic.

11. The fold-in-half collapsible table of claim 1 wherein the first and second inner edges of the first and second tabletop portions are linear and parallel to the hinge axis.

12. The fold-in-half collapsible table of claim 1 wherein the first leg assembly is pivotally connected to the first side rails and the second leg assembly is pivotally connected to the second side rails.

13. The fold-in-half collapsible table of claim 1 wherein:

the planar cross brace is disposed between the first inner edge and the first outer edge of the first tabletop portion; and the tubular cross brace is disposed between the second inner edge and the second outer edge of the second tabletop portion.

14. A cross brace for stiffening a tabletop of a fold-in-half collapsible table, the cross brace comprising:

an elongate rectangular planar portion having elongate opposing side edges and narrow opposing end edges that are perpendicular to the side edges;

a pair of opposing tabs, one disposed at each of the opposing end edges and extending from the rectangular planar portion in a direction perpendicular thereto; and a pair of opposing ribs, one disposed at each of the opposing side edges and extending from the rectangular planar portion in a direction perpendicular thereto.

15. The cross brace of claim 14 further comprising multiple apertures disposed in the rectangular planar portion, the apertures operable to receive fasteners for securing the cross brace to the tabletop.

16. The cross brace of claim 14 further comprising multiple pairs of opposing arcuate cutouts in the opposing ribs, each pair of opposing cutouts disposed adjacent a corresponding one of the tabs.

17. A fold-in-half collapsible table having a use position and a storage position, the collapsible table comprising:

a tabletop that includes:

a first tabletop portion having a top surface, a bottom surface, a first inner edge, and a first outer edge that is parallel to the first inner edge; and a second tabletop portion having a top surface, a bottom surface, a second inner edge, and a second outer edge that is parallel to the second inner edge wherein the first and second inner edges are adjacent each other when the table is in the use position, and separated from each other when the table is in the storage position;

a pair of opposing first side rails attached to the bottom surface of the first tabletop portion between the first inner edge and the first outer edge;

a pair of opposing second side rails attached to the bottom surface of the second tabletop portion between the second inner edge and the second outer edge;

a first leg assembly pivotally connected to the bottom surface of the first tabletop portion between the first side rails, the first leg assembly extending downward from the first tabletop portion when the table is in the use position, the first leg assembly disposed adjacent the first tabletop portion when the table is in the storage position;

a second leg assembly pivotally connected to the bottom surface of the second tabletop portion between the second side rails, the second leg assembly extending downward from the second tabletop portion when the table is in the use position, the second leg assembly disposed adjacent the second tabletop portion when the table is in the storage position;

a pair of opposing hinge assemblies disposed on a hinge axis that is parallel to the second inner edge of the second tabletop portion, each hinge assembly including first and second hinge portions that are rotationally attached to each other, wherein the first hinge portion of each hinge assembly is attached to one of the first side rails and the second hinge portion of each hinge assembly is attached to one of the second side rails, whereby the first and second tabletop portions are operable to pivot with respect to each other about the hinge axis;

a tubular cross brace disposed on the hinge axis between the pair of hinge assemblies and secured to the bottom surface of the second tabletop portion, wherein the tubular cross brace includes opposing ends that are secured to the opposing hinge assemblies;

a first central support brace having a first end pivotally attached to the first leg assembly and a second end pivotally attached to the tubular cross brace;

a second central support brace having a first end pivotally attached to the second leg assembly and a second end pivotally attached to the tubular cross brace; and a planar cross brace secured to the bottom surface of the first tabletop portion and disposed adjacent and parallel to the first inner edge of the first tabletop portion, the planar cross brace comprising:

an elongate rectangular planar portion having elongate opposing side edges and narrow opposing end edges that are perpendicular to the side edges;

a pair of opposing tabs disposed at the opposing end edges of the elongate rectangular planar portion, each tab extending from the elongate rectangular planar portion in a direction perpendicular to the bottom surface of the first tabletop portion, wherein each tab is secured to a corresponding one of the first hinge portions; and a pair of opposing ribs disposed along the opposing side edges of the elongate rectangular planar portion, wherein the ribs are disposed in parallel to the first inner edge of the first tabletop portion and extend from the elongate rectangular planar portion in a direction perpendicular to the bottom surface of the first tabletop portion.

* * * * *